United States Patent [19]

Veillette

[11] 4,438,920

[45] Mar. 27, 1984

[54] EXERCISE DEVICE

[76] Inventor: Pierre Veillette, 6 Pl. Radisson, Apt. 610, Hull, Quebec J8Z 1T7, Canada

[21] Appl. No.: 407,063

[22] Filed: Aug. 11, 1982

[51] Int. Cl.[3] ..... A01B 23/00

[52] U.S. Cl. ..... 272/67; 272/117

[58] Field of Search ..... 272/67, 68, 117, 131, 272/132

[56] References Cited

U.S. PATENT DOCUMENTS

| | | | |
|---|---|---|---|
| 2,475,656 | 7/1949 | Bidak | 272/67 |
| 2,621,043 | 12/1952 | Olmstead | 272/131 |
| 3,068,002 | 12/1962 | Balne . | |
| 3,134,590 | 5/1964 | Young | 272/68 X |
| 3,510,130 | 5/1970 | Ferdinand | 272/67 |
| 3,637,205 | 1/1972 | Bankston | 272/131 |
| 3,806,121 | 4/1974 | Crossley | 272/67 |
| 3,982,755 | 9/1976 | Sarich | 272/117 |

FOREIGN PATENT DOCUMENTS

| | | | |
|---|---|---|---|
| 830916 | 2/1952 | Fed. Rep. of Germany | 272/67 |
| 1246821 | 10/1960 | Fed. Rep. of Germany | 272/117 |

*Primary Examiner*—Richard J. Johnson

*Attorney, Agent, or Firm*—George A. Seaby

[57] ABSTRACT

An exercise device for the hands and wrists includes an elongated cylindrical body, with a sleeve rotatably mounted on each end thereof and a cord, one end of which is fixedly connected to the body between the sleeves. A weight is mounted on the other end of the cord. By alternately squeezing, rotating and releasing the ends of the body, i.e. by squeezing, rotating and releasing one sleeve and then the other sleeve, the cord is coiled around the center of the body to raise the weight.

5 Claims, 3 Drawing Figures

EXERCISE DEVICE

BACKGROUND OF THE INVENTION

1. Field of the Invention

This invention relates to an exercise device, and in particular to a device for exercising the wrists.

While the device of the present invention is primarily a wrist exerciser, it will be readily apparent from the following that the device can also be used to exercise the fingers, hands and the arms in general.

2. Discussion of the Prior Art

There are many wrist exercisers described in the patent art. Examples of such devices are those disclosed in U.S. Pat. Nos. 2,475,656, issued to J. Bidak on July 12, 1949; 3,510,130 issued to I. J. Ferdinand on May 5, 1950; 3,717,338, issued to P. G. Hughes on Feb. 20, 1973; 3,764,131, issued to J. F. G. Rooks on Oct. 9, 1973 and 4,203,591 issued to S. Gibson on May 20, 1980. Most such devices are complicated torsion exercisers, with ends which are rotated against the tension of a spring or the like. The Bidak patent is of the most interest to the present inventor, because the Bidak device is somewhat similar to the exercise device of this invention. However, the Bidak device is rather limited, its use relying on a simple twisting of a rod or shaft.

The object of the present invention is to provide a device, which while relatively simple in terms of structure has exercise capabilities at least as good as those of prior art devices.

GENERAL DESCRIPTION OF THE INVENTION

Accordingly, the present invention relates to an exercise device comprising an elongated, substantially cylindrical body; first and second sleeve means rotatably mounted on the ends of said body for manual gripping by a user, said first and second sleeve means being resilient, whereby the sleeve means can be squeezed against said body to prevent rotation; cord means fixedly connected at one end to said body between said first and second sleeve means; and connector means for connecting the other end of said cord means to a weight.

BRIEF DESCRIPTION OF DRAWINGS

The invention will now be described in greater detail with reference to the accompanying drawing, which illustrates a preferred embodiment of the invention, and wherein.

DESCRIPTION OF PREFERRED EMBODIMENTS

Figure 1:
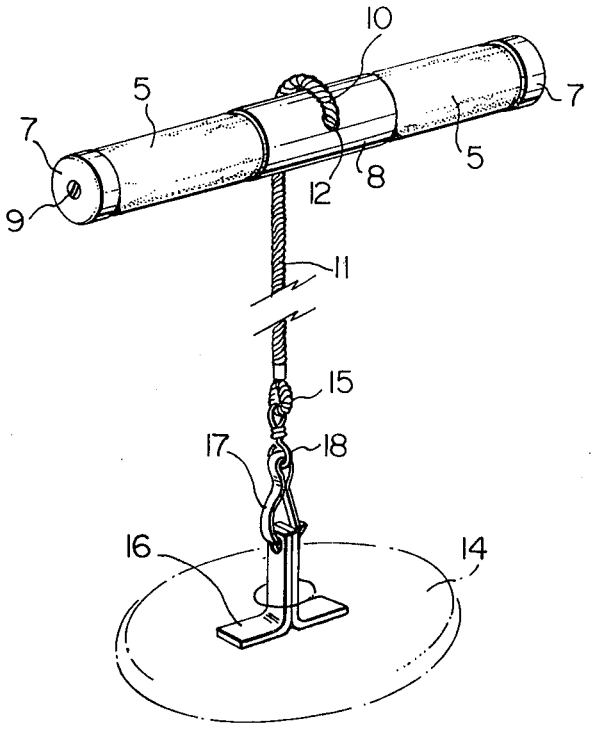
FIG. 1 is a perspective view from above of an exercise device in accordance with the present invention.
Figure 2:
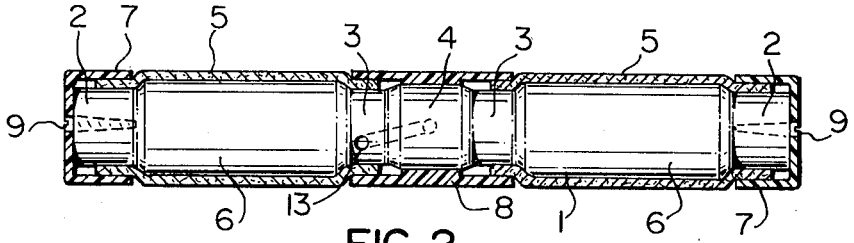
FIG. 2 is a longitudinal sectional view of the top portion of device of FIG. 1.

With reference to the drawing, and in particular to FIGS. 1 and 2, the device of the present invention includes an elongated cylindrical body 1, which may be formed of any suitable material such as wood, metal or plastic. With the cost of materials in mind, plastic is the preferred material. Each outer end 2 of the body 1 is stepped, i.e. outer ends 2 of the body 1 are reduced in diameter with respect to the remainder of the body. Annular grooves 3 are provided on each side of the centre portion 4 of the body 1. The stepped outer ends 2 have substantially the same diameters as each other and as the bottoms of the grooves 3.

A pair of identical sleeves 5 are mounted on the ends of the body 1. The diameter of each sleeve 5 is slightly greater than the diameter of end portion 6 of the body surrounded by the sleeve, so that the sleeve 5 can be rotated with respect to the body 1. The sleeves 5 are formed of resilient material such as leather, plastic or rubber, so that such sleeves can be squeezed against the body 1 to prevent rotation. The sleeves 5 are retained on the body 1 by plastic end caps 7 and a central plastic sleeve 8. Each end cap 7 is connected to the body 1 by a screw 9. The sleeve 8 is stepped internally, i.e. the inner diameter of each end of the sleeve 8 is greater than that of the centre, so that there is sufficient space between the ends of the sleeve 8 and the bottoms of the grooves 3 to receive the inner ends of the sleeves 5. The inner diameters of the caps 7 are the same as the inner diameter of each end of the sleeve 8. While the sleeves 5 can rotate on the body 1, the caps 7 are fixed.

One end 10 of a small diameter rope or cord 11 is connected to the body 1. The rope extends through an opening 12 in the sleeve 8, and through a diagonal hole 13 in the centre portion 4 of the body 1. The hole 13 extends from the centre of the body 1 to the bottom of one of the grooves 3 on the opposite side of the body. The cord 11 is passed through the hole 13 from the centre to the groove 3 and the end is knotted to secure the cord to the body 1. It will be noted that the cord 11 permits limited rotation of the sleeve 8 with respect to the body 1, but, while the sleeves 5 are rotatable, the sleeve 8 is essentially fixed with respect to the body 1.

A conventional circular weight 14 of the type used in weight lifting is removably mounted on the other end 15 of the cord 11. The weight is slid onto an inverted T-shaped holder 16, which is connected to the bottom end 15 of the cord 11 by a spring clip 17 and a hook 18. Obviously, the weight 14 can readily be replaced with a lighter or heavier weight by disconnecting the holder 16 from the clip 17, and sliding the weight 14 off the holder 16. Another weight is placed on the holder 16, and the latter is re-connected to the spring clip 17.

Figure 3:
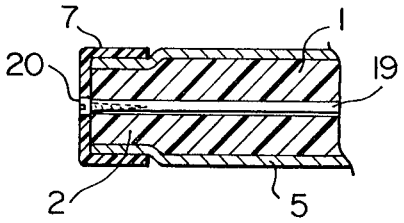
FIG. 3 is a longitudinal sectional view of one end of an alternate form of top portion of the device of the present invention.

While in the embodiment of the invention illustrated in FIGS. 1 and 2 only the sleeves 5 are free to rotate with respect to the body 1, in the embodiment of the invention shown in FIG. 3 the sleeves 5 and the body 1 are free to rotate with respect to a central rod or shaft 19. In the device of FIG. 3, the body 1 and the sleeves 5 are rotatably mounted on the shaft 19, and the end caps 7 are fixedly connected to the shaft 19 by screws 20. Thus, when the sleeves 5 are rotated, the body 1 also rotates, while the end caps 7 and shaft 19 remain fixed.

In order to use the device a weight 14 is mounted on the holder 16. The device is gripped by the sleeves 5, i.e., each of the sleeves 5 is gripped in one hand. By squeezing one side of the device and rotating, the cord 11 can be caused to coil around the central sleeve 8, lifting the weight 14. The pressure on such one side of the device is relaxed, and the other side or sleeve 5 is squeezed and rotated. Thus, by alternately squeezing, rotating and releasing the two ends of the device, the cord 11 can be caused to coil around the sleeve 8 and raise the weight 14. In this manner, the fingers, hands, wrists and arms are exercised. The size of the weight 14 can be changed depending on the strength of the user.

I claim:

1. An exercise device comprising an elongated, substantially cylindrical body; first and second sleeve means rotatably mounted on the ends of said body for manual gripping by a user, said first and second sleeve means being resilient, whereby the sleve means can be squeezed against said body to prevent rotation; cord means fixedly connected at one end to said body between said first and second sleeve means; and connector means for connecting the other end of said cord means to a weight whereby, by squeezing one sleeve, releasing the other sleeve and rotating the squeezed sleeve and body, the cord is wound around the body and the weight is raised.

2. An exercise device according to claim 1, including a third sleeve means on said body for retaining the inner ends of said first and second sleeve means against said body.

3. An exercise device according to claim 2, including cap means on each end of said body for retaining the outer ends of said first and second sleeve means against said body.

4. An exercise device according to claim 3, wherein said third sleeve means and cap means are substantially fixed with respect to said first and second sleeve means.

5. An exercise device according to claim 3, including shaft means extending through said body, said cap means being connected to said shaft means, said body being rotatable with respect to said shaft means whereby squeezing and rotation of one said first and second sleeve means causes rotation of said body with respect to said cap means and shaft.

* * * * *